US005787831A

United States Patent [19]

von Schwarzenfeld

[11] Patent Number: 5,787,831

[45] Date of Patent: Aug. 4, 1998

[54] SAIL WHICH CAN BE ROLLED-UP OR REEFED

[76] Inventor: Wolfgang Kraker von Schwarzenfeld, Yate Pegasus, Anfi del Mar Arguineguin, Gran Canaria, Spain

[21] Appl. No.: 373,192

[22] PCT Filed: Apr. 23, 1994

[86] PCT No.: PCT/EP94/01274

§ 371 Date: Jan. 13, 1995

§ 102(e) Date: Jan. 13, 1995

[87] PCT Pub. No.: WO94/26587

PCT Pub. Date: Nov. 24, 1994

[30] Foreign Application Priority Data

May 14, 1993 [DE] Germany ..... 93 07 368 U

[51] Int. Cl.[6] ..... B63H 9/10

[52] U.S. Cl. ..... 114/106; 114/104

[58] Field of Search ..... 114/103–107

[56] References Cited

U.S. PATENT DOCUMENTS

| | | | |
|---|---|---|---|
| 2,107,303 | 2/1938 | Ljungstrom | 114/106 |
| 3,298,346 | 1/1967 | Cochran | 114/103 |
| 3,310,018 | 3/1967 | Roberts, Jr. et al. | 114/104 |
| 3,391,668 | 7/1968 | Birchill | 114/103 |
| 4,741,282 | 5/1988 | Duke | 114/103 |
| 4,753,186 | 6/1988 | Paras | 114/103 |

FOREIGN PATENT DOCUMENTS

| | | |
|---|---|---|
| 2 557 852 | 7/1985 | France . |
| 83 22 949.3 | 11/1983 | Germany . |
| 86 24 010.2 | 2/1987 | Germany . |
| 92 15 522.7 | 4/1993 | Germany . |

*Primary Examiner*—Sherman Basinger
*Attorney, Agent, or Firm*—Anderson, Kill & Olick, P.C.

[57] ABSTRACT

A reefed sail including an inflatable luff chamber which forms an integral part of the sail and defines a reefing axis.

4 Claims, 2 Drawing Sheets

SAIL WHICH CAN BE ROLLED-UP OR REEFED

BACKGROUND OF THE INVENTION

The invention deals with a sail, in particular a foresail, which can be rolled-up and reefed. It is known to provide sails with rolling-up and reefing arrangements, in order to either be able to furl or take-in the sails or to reduce their area, depending upon the wind conditions.

A problem involving rolling installations, in particular of foresails, consists in that, when rolling up the sail, the leech and the foot of the foresail, for instance of a genoa jib, wrap themselves tightly around the forestay while the surface of the sail, which is becoming increasingly smaller, assumes increasingly a baggy aspect, so that possibly under wind pressure a wildly whipping piece of sail remains in the upper third of the forestay region. An arrangement is known from DE-A-42 35 202 which enables to wrap the sail around one of its ropes, for which purpose a rod-shaped wrapping or windup traverse extending from rope to rope is provided.

An improved reel or pulley arrangement is described in the publication Yacht Aug. 1993, where the wire in the fore rope is reversed in the top and runs into a rocker in the reel arrangement below, wherein a stiffening batten is slipped in between the two wire guides in order to enable here a stiffer and larger surface roll-up or reeling region.

It is disadvantageous in the known solution, apart from the certainly improved reefing properties, that a foresail rolled-out up in such a way cannot be stricken-off or taken-in.

The object of the invention is to provide means which improves the reefing properties of the sail as well as largely simplifying the roll-out and take-in possibilities of the sail.

SUMMARY OF THE INVENTION

This object of the invention is achieved by providing in a sail of the previously described type an inflatable luff chamber forming the reeling-or reefing-axis.

The invention achieves a multitude of advantages:

Thus, an inflatable luff chamber provides an optimum assist when reefing the sail, since it can serve as a roll-up axis with an appropriate radius, making the roll-up process easier. On the other hand, the inflatable luff chamber enables also an easy unrolling or rolling-up of the sail, for instance, if it has to be taken up since stiffening battens, as provided in the state of the art described above, can be completely done without. Also, the rolling reefing tubes provided in other rolling reefing installations need not be used here.

Another advantage of the invention consists in that it permits to replace the sails at any time, whereas conventional roll-up sails can be unfolded and taken-up only in calm, wind-free weather, in particular, they cannot be replaced during a storm, which the invention permits to do without any problems whatsoever. If several rollable sails exist on a boat, they hamper the sailing -in- the wind properties of the boat, which is not the case when using the sail according to the present invention.

For the rest of it, it is achieved by the invention that the sails are no longer exposed to wind, weather and storm, as is usual with roll-up sails, so that they do not wear as rapidly as before. Accidents due to ruffling or sweeping-out of rolled sails, for instance, in port, if a crew is not longer on board, are also avoided by the sail of the present invention.

Viewed by themselves, sails with air chambers, especially for improving the approach flow profile, are known, for instance, from the DE-A-32 11 641 or the DE-U-83 22 949. An inflatable sail configured overall as a hollow profile is shown in the DE-U-79 00 123 or the De-U-86 24 010. References or suggestions directed to facilitating or assisting the reefing or unrolling of the sails cannot be discerned from these known documents.

It is provided in a particular embodiment of the invention that a luff has a conicity changing up to the edge regions and extending across its length.

Additional advantages can be obtained by pre-profiling the luff chamber. Thus, it is possible, depending upon the type of the sail, to maintain the desired pre-profiling when reefing by means of an appropriately pre-profiled chamber. If, for instance, a bulging or bellying sail is desired, an appropriately pre-profiled luff leading edge chamber can also maintain the desired bellyness in the reefing positions, so that an optimum sail profile is assured for every size of sail, which is not achievable with other known solutions.

According to the invention, the foresail can be provided with additional inflatable chambers associated with the luff chamber. Providing a plurality of inflatable air chambers is per se known, for instance, from DE-U-83 22 949, which was discussed above, guide-ribs or grooves enabling a symmetrical rolling or folding.

The luff chamber can be expediently configured as an aerodynamically pre-profiled inflatable rubber-or-plastics-hose, either as an integral component of the sail itself, or be insertable into an appropriately configured sail pocket. The hose forming the luff chamber or the luff pocket receiving the hose can expediently be provided with reinforcements. These can be separate elements, however, reinforcements can also be placed therein by weaving technology.

In order to facilitate a possible venting when taking the sail in, the luff chamber can comprise a venting groove pointing inwardly or, for instance, a continuously perforated venting hose.

The invention also provides for the luff-chamber to be located in the region of the top of a sail, with a remotely-actuated outlet valve, possibly with a ripping line guided through the luff chamber. The venting of the luff chamber can, however, be achieved in another way, possibly by connecting a pump, previously used for inflating the luff chamber, with its suction side to the luff chamber during take-up of the sail, so that said luff chamber can be evacuated in short order.

BRIEF DESCRIPTION OF THE DRAWINGS

Additional features, details and advantages of the present invention will become apparent from the following description as well as from the drawing, wherein.

DETAILED DESCRIPTION OF THE PREFERRED EMBODIMENTS

Figure 1B:
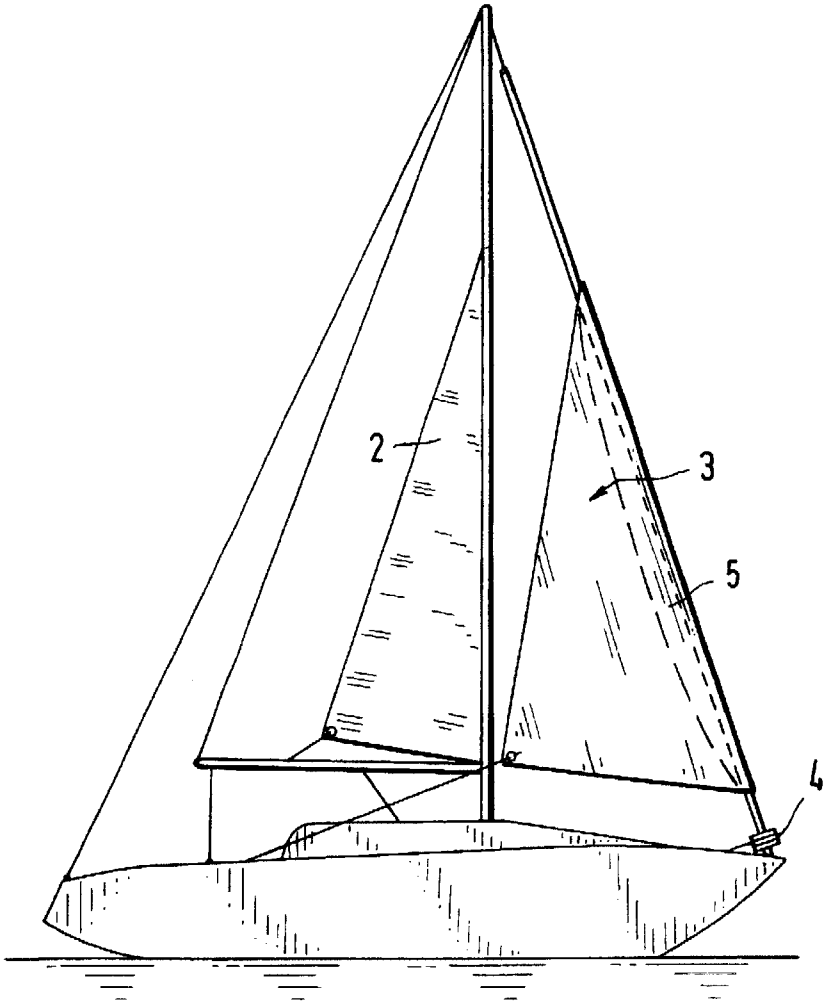
FIGS. 1*a* and 1*b* show diagrammatic side views of reefed sails.
Figure 1A:
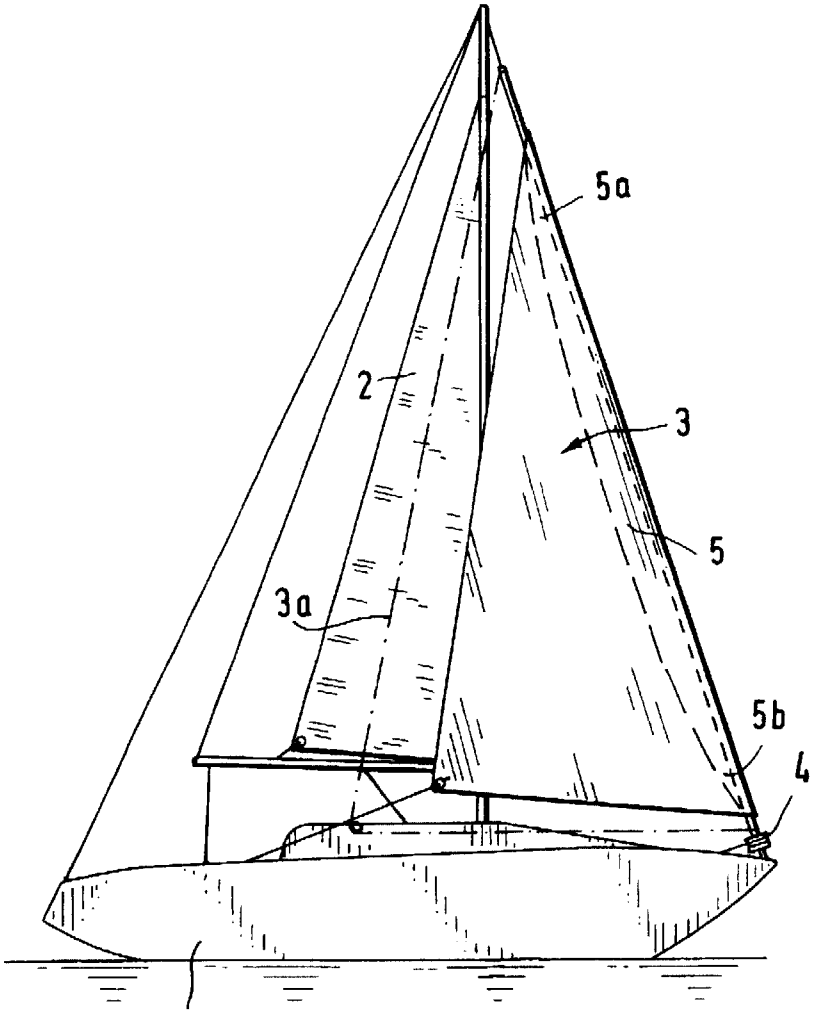

FIG. 1*a* shows a sailing yacht overall designated by 1 with a reefed main sail 2, as well as a reefed foresail 3 in a first reefing state, wherein the size of the foresails 3, for instance a genoa jib, is indicated by a broken dotted line in the un-reefed state, the silhouette of which carries the reference number 3*a*.

Figure 2:
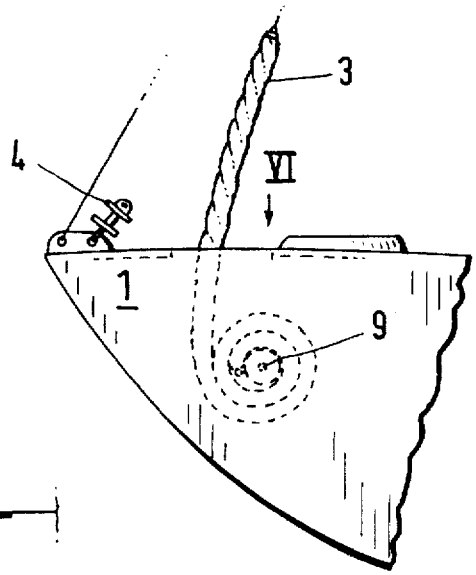
FIG. 2 shows the bow area of a ship with a foresail rolling installation.

FIG. 2 shows the main sail 2, as well as the foresail 3, in a more pronounced reefed state. The bottom rolling drum, provided for reefing, is designated by the numeral 4. The drum can be mechanically or electro-motively driven in per se known manner, which however is of no particular importance here.

Figure 3:
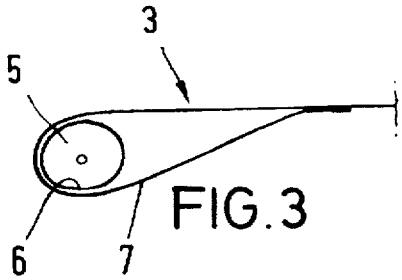
FIG. 3 shows a simplified cross-section of an embodiment of a sail according to the invention.

As results particularly from FIG. 3, the foresail 3 is provided according to the invention with an inflatable luff chamber 5, which chamber forms an integral component of the sail 3.

The luff chamber can, as indicated in FIG. 2, be a pre-profiled in a bulging manner, in such a way that, for instance, tapering regions 5*a* and 5*b* result.

If the foresail is reefed, the respectively desired profile of the sail is maintained also in its reduced state by the pre-profiling of the luff chamber and with this the desired optimum sailing properties are maintained.

The luff chamber 5 can, as indicated in FIG. 3, be formed by an inflatable rubber-or plastics-hose 6, which is integrated into an appropriately shaped sail pocket 7.

Figure 5:
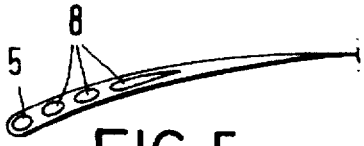
FIG. 5 shows a simplified cross-section of another embodiment of a sail.

As shown in FIG. 5, additional inflatable chambers 8 can be allotted to the inflatable luff chamber 5. These can be housed in their proper pockets or in a common pocket. They can be designed as individual elements or in such a way, that the luff chamber 5 is formed by an appropriately profiled hose with several air chambers.

Figure 6:
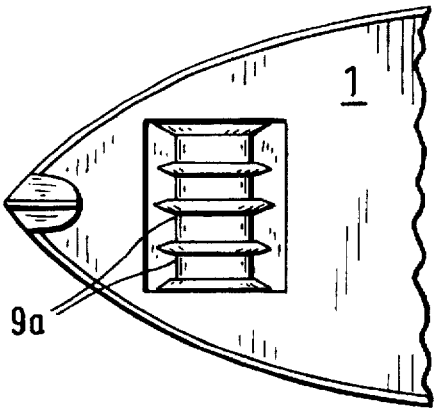
FIG. 6 shows a plan view of the bow region with a multiplicity of foresail drums for receiving a plurality of foresails according to the invention.

For taking-up the sail in the completely reefed state, it can be for instance, dismantle off a reefing drum 4 and can be wind up onto a drum 9 provided in the bow chamber, which then rolls up the sail in a manner shown in FIG. 2. A plurality of sale-receiving drums 9*a* can also be provided in the bow region for receiving different foresails, as shown in FIG. 6.

Figure 4:
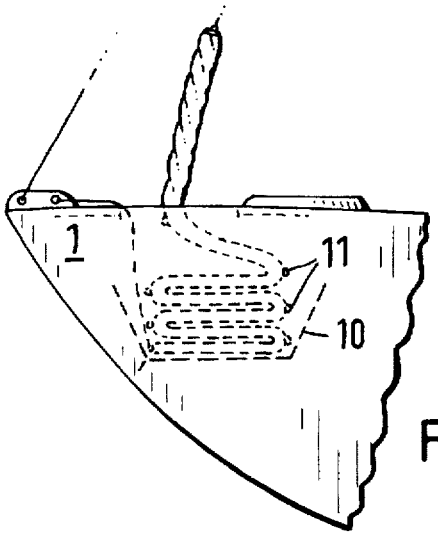
FIG. 4 shows the bow region of a ship with a foresail receiving cassette.

If the sail is not rolled up during take-in, rather if it is folded, appropriate receiving cassettes 10 can be provided. According to the invention, the hose 6, forming the luff chamber 5, can be equipped with lateral ribs 11 or the like, in order to enable a sort of constrained folding, as shown in FIG. 4.

Herein the functional mode is as follows:

For attaching the sail, the sail top of the foresail is fastened to the jib by a swivel shackle and is pre-hoisted and, after being taken-off the drum 9, it is fastened to the roll-up drum 4. Herein the luff chamber, which is devoid of air, is pumped-up and the sail can be rolled out, wherein rolling-out and pumping-up can be performed simultaneously or consecutively. In order to facilitate the pre-hoisting of the sail, the sail top of the foresail or the swivel shackle can be looped or attached to the forestay by an additional shackle, which is now shown in detail in the Figures.

The take-in or recovery of the sail is performed in a reverse sequence:

To begin with, the sail is wound around the luff chamber by means of same. A venting valve, which may be provided in the top region is opened, the sail is dismantled off the roll-up drum 4 and is looped around the drum 9, and is further rolled up by same wherein, for instance, the air is pressed out of the luff chamber. Instead of the venting through a venting valve, the luff chamber can be rapidly pumped-out by connecting it to the suction stub of an air pump.

Naturally, the embodiment examples described in the invention can be subjected to numerous modifications without abandoning the basic concept of the invention, as has already been expounded above. The sail 3 can be configured for example, also as a "twin blister". The forestay chamber can, for instance, represent the common rolling-up axis in a twin blister. The twin blister can be symmetrically reduced in its area or recovered by a common rolling axis.

I claim:

1. A sail arrangement, comprising:

a sail;

means for reefing the sail; and an inflatable luff chamber forming an integral part of the sail and defining a reefing axis, wherein the luff chamber is formed as one of an aerodynamically profiled rubber hose and an aerodynamically profiled plastic hose, and wherein the sail has a pocket for receiving the one hose.

2. A sail arrangement according to claim 1, wherein the luff chamber has a changing cross-sectional profile along an entire length of the luff chamber, with the changing cross-sectional profile tapering toward edge regions of the luff chamber.

3. A sail arrangement according to claim 1 comprising at least one additional inflatable chamber forming an integral part of the sail.

4. A sail arrangement according to claim 1, wherein the reefing means comprises a roll-up drum, and wherein the luff chamber is looped around the roll-up drum.

* * * * *